US006948988B2

(12) United States Patent
Okabe

(10) Patent No.: US 6,948,988 B2
(45) Date of Patent: Sep. 27, 2005

(54) HYDRAULIC TILT SYSTEM FOR MARINE PROPULSION DEVICE

(75) Inventor: Yoshihiko Okabe, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/444,143

(22) Filed: May 22, 2003

(65) Prior Publication Data

US 2004/0014375 A1 Jan. 22, 2004

(30) Foreign Application Priority Data

May 22, 2002 (JP) ..... 2002-148124

(51) Int. Cl.[7] ..... B63H 20/08
(52) U.S. Cl. ..... 440/61 R; 440/53
(58) Field of Search ..... 440/1, 53, 61 R; 137/854; 14/71.7

(56) References Cited

U.S. PATENT DOCUMENTS

| | | | | |
|---|---|---|---|---|
| 4,565,528 A | | 1/1986 | Nakase | 440/1 |
| 4,631,035 A | | 12/1986 | Nakahama | 440/61 R |
| 4,702,714 A | | 10/1987 | Nakase | 440/61 R |
| 4,718,330 A | | 1/1988 | Mitton | 92/129 |
| 4,778,414 A | | 10/1988 | Taguchi | 440/1 |
| 4,786,263 A | | 11/1988 | Burmeister et al. | 440/53 |
| 4,813,896 A | | 3/1989 | Koike et al. | 440/61 R |
| 4,909,766 A | | 3/1990 | Taguchi | 440/61 R |
| 4,990,111 A | | 2/1991 | Saitoh et al. | 440/61 R |
| 5,007,866 A | | 4/1991 | Okita | 440/61 R |
| 5,018,994 A | | 5/1991 | Okita | 440/61 R |
| 5,032,094 A | * | 7/1991 | Katogi | 440/61 R |
| 5,067,919 A | | 11/1991 | Okita | 440/61 R |
| 5,215,484 A | | 6/1993 | Saito | 440/61 R |
| 5,366,393 A | | 11/1994 | Uenage et al. | 440/1 |
| 5,389,019 A | | 2/1995 | Tsujii | 440/61 R |
| 5,544,381 A | * | 8/1996 | Alexander | 14/71.7 |
| 5,720,637 A | | 2/1998 | Nakamura | 440/61 R |
| 5,816,872 A | | 10/1998 | Saito | 440/61 R |
| 5,984,741 A | | 11/1999 | Nakamura et al. | 440/61 R |
| 6,015,318 A | | 1/2000 | Uematsu et al. | 440/61 R |
| 6,106,343 A | | 8/2000 | Nakamura | 440/61 R |
| 6,183,320 B1 | | 2/2001 | Natsume | 440/53 |
| 6,213,823 B1 | * | 4/2001 | Nakamura et al. | 440/61 R |
| 6,273,770 B1 | | 8/2001 | Saito | 440/61 R |
| 6,276,976 B1 | | 8/2001 | Saito | 440/61 R |
| 6,328,616 B1 | * | 12/2001 | Nakamura et al. | 440/61 R |

FOREIGN PATENT DOCUMENTS

| | | |
|---|---|---|
| DE | 4424927 A1 | 1/1996 |
| JP | 9-315388 | 12/0000 |

* cited by examiner

*Primary Examiner*—Lars A. Olson
(74) *Attorney, Agent, or Firm*—Knobbe, Martens, Olson & Bear LLP

(57) ABSTRACT

An outboard motor includes a drive unit and a bracket assembly mounted on an associated watercraft. The bracket assembly includes a swivel bracket carrying the drive unit for pivotal movement about a steering axis and a clamping bracket supporting the swivel bracket for pivotal movement about a tilt axis. A hydraulically operated tilt unit tilts the drive unit with the swivel bracket relative to the clamping bracket. A fluid pump pressurizes a working fluid within the tilt unit. A relief valve relieves pressure that is applied to the working fluid when the pressure exceeds a preset magnitude, and an adjustment mechanism is provided to adjust the preset magnitude.

25 Claims, 8 Drawing Sheets

HYDRAULIC TILT SYSTEM FOR MARINE PROPULSION DEVICE

PRIORITY INFORMATION

This application is based on and claims priority to Japanese Patent Application No. 2002-148124, filed on May 22, 2002, the entire contents of which is hereby expressly incorporated by reference.

BACKGROUND OF THE INVENTION

1. Field of the Invention

The present invention relates generally to a hydraulic tilt system for a marine propulsion device, and more particularly to a hydraulic tilt system that has a relief valve for relieving pressure that is applied to a working fluid.

2. Description of Related Art

Relatively small watercrafts can be provided with a marine propulsion device that has a drive unit mounted on a transom of the watercraft. The drive unit carries a propelling unit such as, for example, a propeller that propels the watercraft. A typical marine propulsion device is an outboard motor.

The outboard motor typically has a bracket assembly to support the drive unit on an associated watercraft. The bracket assembly includes a swivel bracket carrying the drive unit for pivotal movement about a steering axis, and a clamping bracket supporting the swivel bracket for pivotal movement about a tilt axis that lies generally normal to the steering axis.

The outboard motor can be provided with a hydraulic tilt system that tilts the drive unit together with the swivel bracket relative to the clamping bracket and, thus, relative to the watercraft. The hydraulic tilt system can incorporate a tilt cylinder extending generally vertically. A tilt piston is slidably disposed within the tilt cylinder and divides an inner cavity of the tilt cylinder into first and second chambers. A piston rod extends from the piston through the second chamber and outwardly beyond one end of the tilt cylinder. The piston rod can be coupled with the swivel bracket or the clamping bracket, while the other end of the tilt cylinder can be coupled with the rest of the clamping bracket or the swivel bracket.

A fluid pump pressurizes a working fluid that is selectively delivered to the first chamber and the second chamber such that the piston rod extends or retracts relative to the tilt cylinder, respectively. With the extending or retracting movement of the piston rod, the swivel bracket together with the drive unit is tilted up or down, respectively.

The working fluid in the first or second chamber can have excessive (i.e., unnecessarily high) pressure. For instance, the fluid pump can continuously pressurize the working fluid even after the piston has reached the limit of its stroke at either end of the tilt cylinder. Under the continuous pressurization of the working fluid, the first or second chamber can build higher pressure than is necessary. In order to relieve the pressure built in the first or second chambers, relief valves, which allow the fluid to move toward, for example, a fluid reservoir, can be provided.

Such relief valves are well known and, for example, U.S. Pat. Nos. 4,778,414, 4,813,896, 4,909,766, 4,990,111 and 5,984,741 disclose the relief valves.

In general, the drive unit with the swivel bracket can move in a range between a fully lowered position and a fully raised position. The range is conveniently divided into a trim adjustment range and a tilt range. The trim adjustment range covers a portion of the range from the fully lowered position to a certain position. Thrust force of the propeller can slightly lift up the bow of the watercraft when the drive unit is in the trim adjustment range and the watercraft can relatively easily gather speeds for high speed running. The tilt range, in turn, covers the rest of the range from the certain position to the fully raised position. The entire drive unit can be raised out of a body of water with the watercraft resting on the surface of the water body when the drive unit is placed at a relatively higher position in the tilt range. The propeller also is out of the body of water under this condition.

The drive unit typically is continuously raised from the trim range to the tilt range. Normally, the operator stops the operation of the hydraulic tilt system at a suitable position of the drive unit in the trim range when moving. Thus, the drive unit normally does not raise into the tilt range without an intentional operation of the tilt system by the watercraft's operator.

Sometimes, however, the operator does not notice that the drive unit is moving into the tilt range and the operator can accelerate the engine speed without stopping the operation of the tilt system. Under this condition, relatively large pressures can occur in the first or second chamber as a result of the weight of the outboard motor and the thrust force of the propeller. If the pressure is larger than a preset pressure of the relief valve, the relief valve can open to relieve the pressure and the drive unit lowers to the trim range.

The preset pressure, however, varies in accordance with the properties of the associated watercrafts and the outboard motors. That is, the preset pressure depends on a size of the watercrafts and a horsepower of the outboard motors, for example. Various types of relief valves thus are necessary for being adapted to those watercrafts and outboard motors. However, preparing those relief valves increases cost and also adds the troublesome management of the relief valves.

SUMMARY OF THE INVENTION

One aspect of the invention involves a marine propulsion device that comprises a drive unit adapted to be mounted on an associated watercraft for pivotal movement about a tilt axis that extends generally horizontally. A hydraulically operated tilt unit operating between the drive unit and the watercraft. A fluid pump pressurizes working fluid within the tilt unit. A relief valve communicates with the tilt unit so as to relieve the pressure of the working fluid when the pressure exceeds a preset magnitude. An adjustment mechanism cooperates with the relief valve to adjust the preset magnitude. In this manner, the preset magnitude can be set in accordance with the properties of the associated watercraft and propulsion device.

In accordance with another aspect of the present invention, an outboard motor comprises a drive unit and a bracket assembly adapted to be mounted on an associated watercraft. The bracket assembly comprises a swivel bracket arranged to carry the drive unit for pivotal movement about a steering axis. A clamping bracket is arranged to support the swivel bracket for pivotal movement about a tilt axis that lies generally normal to the steering axis. A hydraulically operated tilt unit operates between the swivel bracket and the clamping bracket to tilt the drive unit. A fluid pump is arranged to pressurize working fluid within the tilt unit. A relief valve communicates with the tilt unit so as to relieve the pressure of the working fluid when the pressure exceeds a preset magnitude. An adjustment mechanism is arranged to adjust the preset magnitude.

In accordance with a further aspect of the present invention, a hydraulic tilt system is provided for a marine propulsion device. The tilt system comprises a tilt cylinder. A piston is slidably disposed within the tilt cylinder. The tilt cylinder defines first and second chambers with the piston. A piston rod extends from the piston through the second chamber and outwardly beyond one end of the tilt cylinder. A fluid pump is arranged to selectively pressurize working fluid within the first chamber or in the second chamber. A relief valve is arranged to relieve the pressure within the first chamber or the second chamber when the pressure exceeds a preset magnitude. An adjustment mechanism is arranged to adjust the preset magnitude.

These and other aspects of the present invention will become readily apparent to those skilled in the art from the following detailed description of the preferred embodiments, which refers to the attached figures. The invention is not limited, however, to the particular embodiments that are disclosed.

BRIEF DESCRIPTION OF THE DRAWINGS

FIG. 8(*a*) illustrates a retracted position of the adjustment mechanism wherein the an end of the cam follower (which is on a side opposite to the cam) is positioned close to the cam. FIG. 8(*b*) illustrates in intermediate position of the adjustment mechanism in which the end of the cam follower is positioned farther from the cam than the position illustrated in FIG. 8(*a*). FIG. 8(*c*) illustrates an fully extended position of the adjustment mechanism in which the end of the cam follower is positioned fully apart from the cam.

DETAILED DESCRIPTION OF THE PREFERRED EMBODIMENTS

Overall Construction Of Outboard Motor

Figure 1:
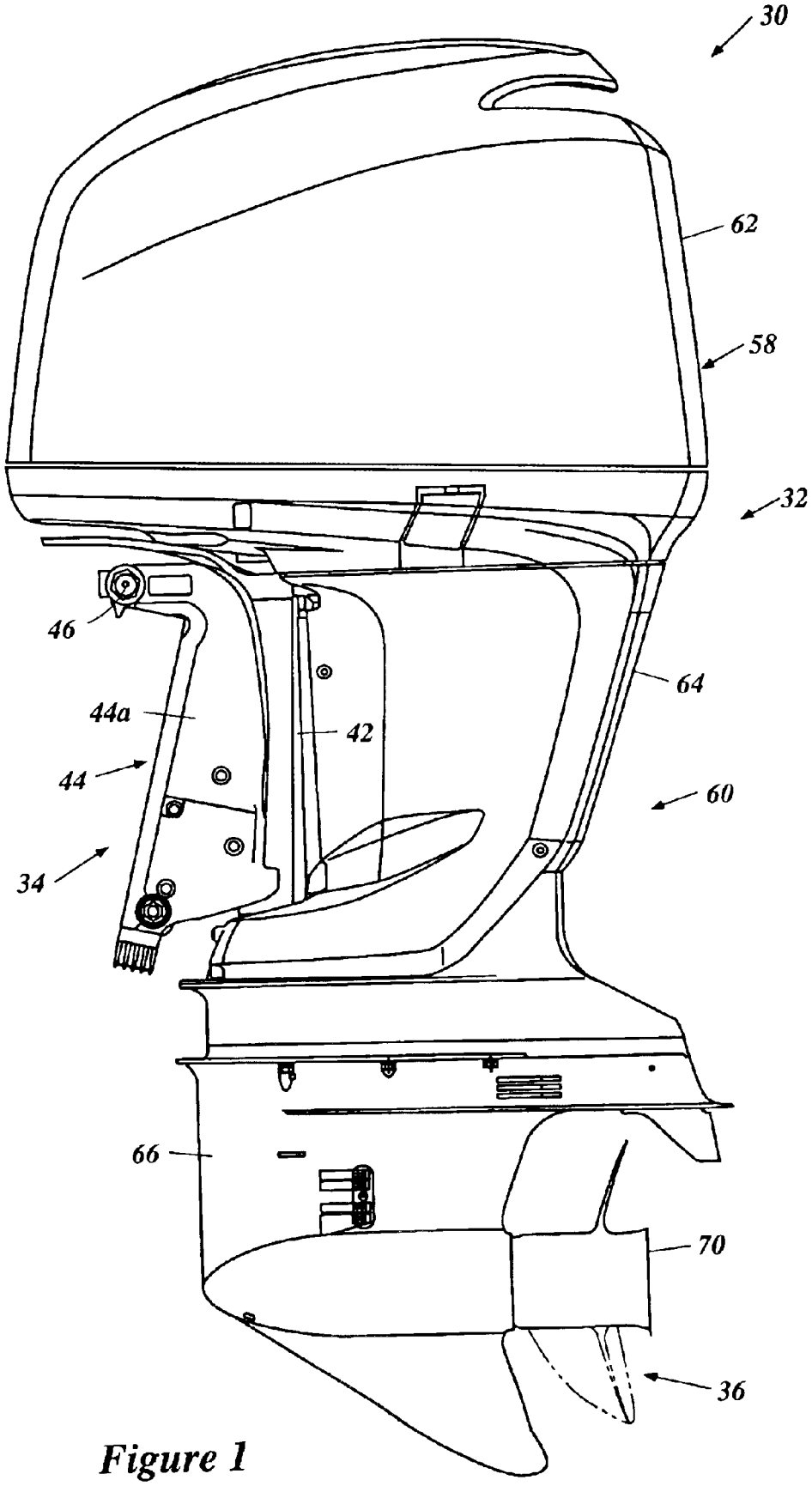
FIG. 1 is a side elevational view of an outboard motor configured in accordance with a preferred embodiment of the present invention.

With reference to FIGS. 1–4, an overall construction of an outboard motor 30 configured in accordance with certain features, aspects and advantages of the present invention will be described. While the present hydraulic tilt and trim adjustment system is described herein in connection with the outboard motor, the system can be used with other types of marine drives as well.

In the illustrated arrangement, the outboard motor 30 comprises a drive unit 32 and a bracket assembly 34. The bracket assembly 34 supports the drive unit 32 on a transom of an associated watercraft and places a propelling unit 36 in a submerged position with the watercraft resting on the surface of a body of water.

The bracket assembly 34 preferably comprises a swivel bracket 42, a clamping bracket 44, a steering shaft and a pivot pin 46. The steering shaft extends through a steering post of the swivel bracket 42 and is affixed to the drive unit 32 by upper and lower mount assemblies. The steering shaft is pivotally journaled for steering movement about a generally vertically extending steering axis of the steering shaft.

The clamping bracket 44 comprises a pair of bracket arms 44*a*, 44*b* spaced apart from each other. The pivot pin 46 preferably extends between upper ends of the respective bracket arms 44*a*, 44*b* and connects to the upper ends of both bracket arms 44*a*, 44*b*. A top of each bracket arm 44*a*, 44*b* preferably is formed as a hook and is fitted over the top of the watercraft transom. The pivot pin 46 also completes a hinge coupling between the swivel bracket 42 and the clamping bracket 44. That is, the pivot pin 46 transversely extends through the bracket arms 44*a*, 44*b* and the upper portion of the swivel bracket 42 such that the clamping bracket 44 supports the swivel bracket 42 for pivotal movement about a generally horizontally extending tilt axis of the pivot pin 46. The drive unit 32 thus can be tilted (raised or lowered) about the tilt axis with movement of the swivel bracket 42.

The illustrated drive unit 32 can move in a range between a fully lowered position and a fully raised position. The range is divided into a trim adjustment range and a tilt range. The trim adjustment range covers a portion of the range from the fully lowered position and to a certain position. Thrust force of the propelling unit 36 can slightly lift up the bow of the watercraft when the drive unit is in the trim adjustment range and the watercraft can relatively easily gather speed. The tilt range, in turn, covers the rest of the range from the certain position to the fully raised position. Additionally, a lower portion of the drive unit 32 preferably is slightly inclined toward the watercraft beyond a vertical (perpendicular) plane when the drive unit 32 is fully trimmed down.

In this arrangement, trim cylinder units 50 (FIGS. 3 and 4) primarily are used for the movement of the drive unit 32 in the trim adjustment range and a tilt cylinder unit 52 is used for the movement of the drive unit 32 in the tilt range. The trim cylinder units 50 and the tilt cylinder unit 52 preferably are combined with each other and with other components therefor to form a hydraulic tilt and trim adjustment system 54. The entire structure and operations of the hydraulic tilt and trim adjustment system 54 will be described in greater detail below.

As used in this description, the term "tilt movement," when used in a broad sense, typically includes both tilt movement and trim adjustment movement of the outboard motor 30. Thus, the term "tilt movement" is used in accordance with this broad meaning, unless the trim adjustment movement is specifically mentioned. Similarly, the term "tilt" means both tilt and trim adjustment.

Also, the term "horizontally" means that the subject portions, members or components extend generally in parallel to the surface of the body of water when the associated watercraft is substantially stationary with respect to the surface of the body of water and when the drive unit 32 is in its fully trimmed down position. The term "vertically" means that portions, members or components extend generally normal to those that extend horizontally. In addition, the terms "forward," "forwardly" and "front" mean at or to the side where the bracket assembly 32 is located, and the terms "rear," "reverse," "backwardly" and "rearwardly" mean at or to the opposite side of the front side, unless indicated otherwise or otherwise readily apparent from the context in which the term is used.

With reference again to FIG. 1, the illustrated drive unit 32 comprises a power head 58 and a housing unit 60. The power head 58 includes a prime mover (not shown) and a protective cowling 62. The prime mover in this arrangement is an internal combustion engine (not shown). Other types of prime movers such as, for example, an electric motor can replace the engine. The housing unit 60, in turn, includes a driveshaft housing 64 and a lower unit 66.

The power head 58 is disposed atop the housing unit 60 and houses the engine therein. The protective cowling 62 preferably comprises a bottom cowling member and a top cowling member that is detachable from the bottom cowling member.

The engine in the illustrated arrangement, for example, is a multi-cylinder engine and operates on a four-cycle combustion principle, although any other types of conventional engines can be applied. The engine preferably has a throttle valve that regulates an amount of air delivered to combustion chambers. The throttle valve is controllable (for acceleration or deceleration of the engine operation) by the operator through a throttle control mechanism. An amount of fuel that is delivered to the combustion chambers also is regulated by suitable devices such as, for example, fuel injectors or carburetors. Generally, the fuel amount is controlled so as to vary in response to the air amount.

The driveshaft housing 64 depends from the power head 58 and the lower unit 66 further depends from the driveshaft housing 64. A driveshaft extends generally vertically through the driveshaft housing 64 and through a portion of the lower unit 66. The drive shaft 98 is coupled with a crankshaft of the engine to be driven thereby.

The lower unit 66 carries the propelling unit 36. In the illustrated arrangement, the propelling unit 36 includes a propeller 70 which is affixed to a propulsion shaft that extends generally horizontally within the lower unit 66. A transmission preferably is provided between the driveshaft and the propulsion shaft. The transmission preferably couples together the two shafts which lie generally normal to each other (i.e., at a 90° shaft angle), with bevel gears. The driveshaft drives the propulsion shaft through the transmission to rotate the propeller 70. The transmission can include a clutch mechanism to change the rotational direction of the propeller 70 among forward, neutral and reverse. The watercraft can advance forwardly when the clutch mechanism is in the forward position and backwardly when the clutch mechanism is in the reverse position. The propelling unit 36 can also take the form of a dual counter-rotating system, a hydrodynamic jet, or any of a number of other suitable propulsion devices.

Structure of Hydraulic Tilt and Trim Adjustment System

Figure 2:
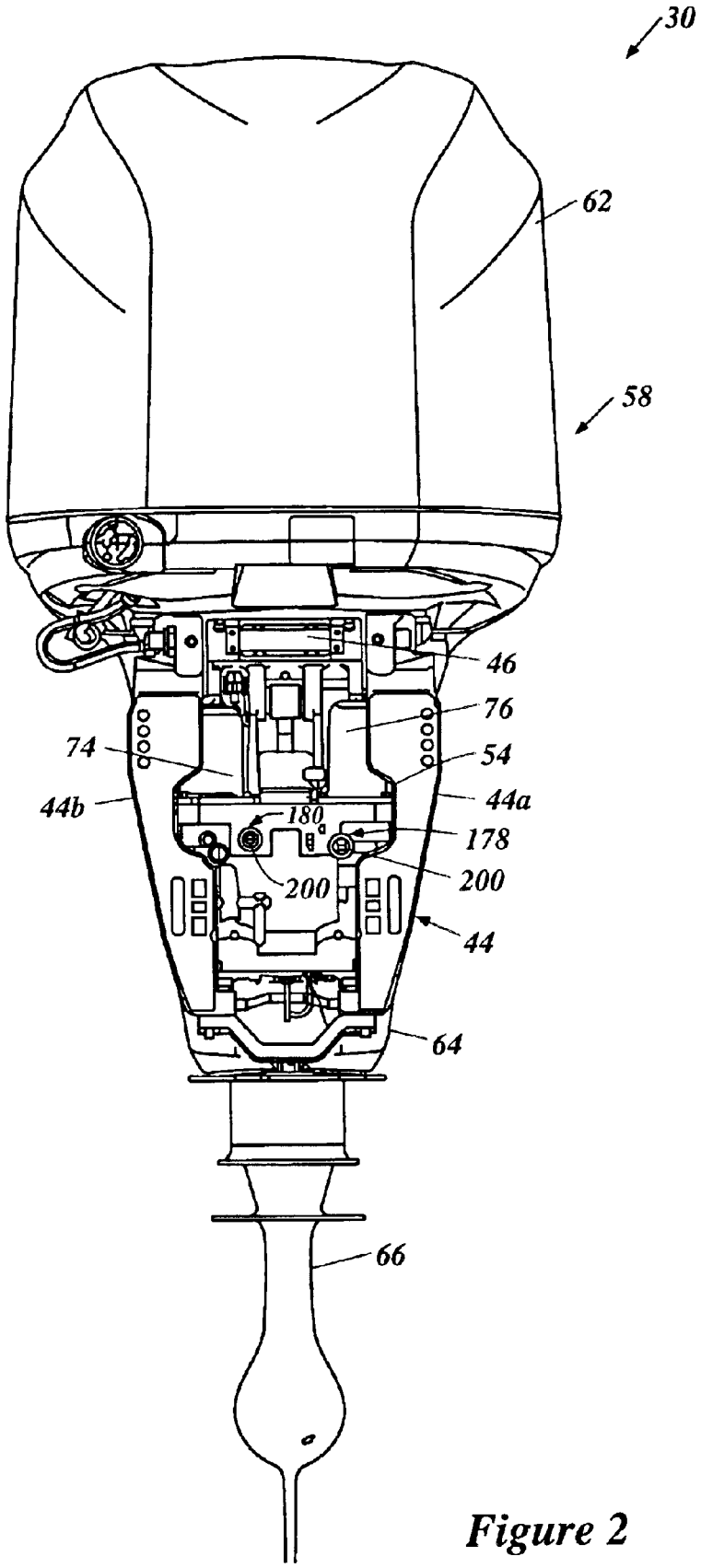
FIG. 2 is a front elevational view of the outboard motor of FIG. 1
Figure 3:
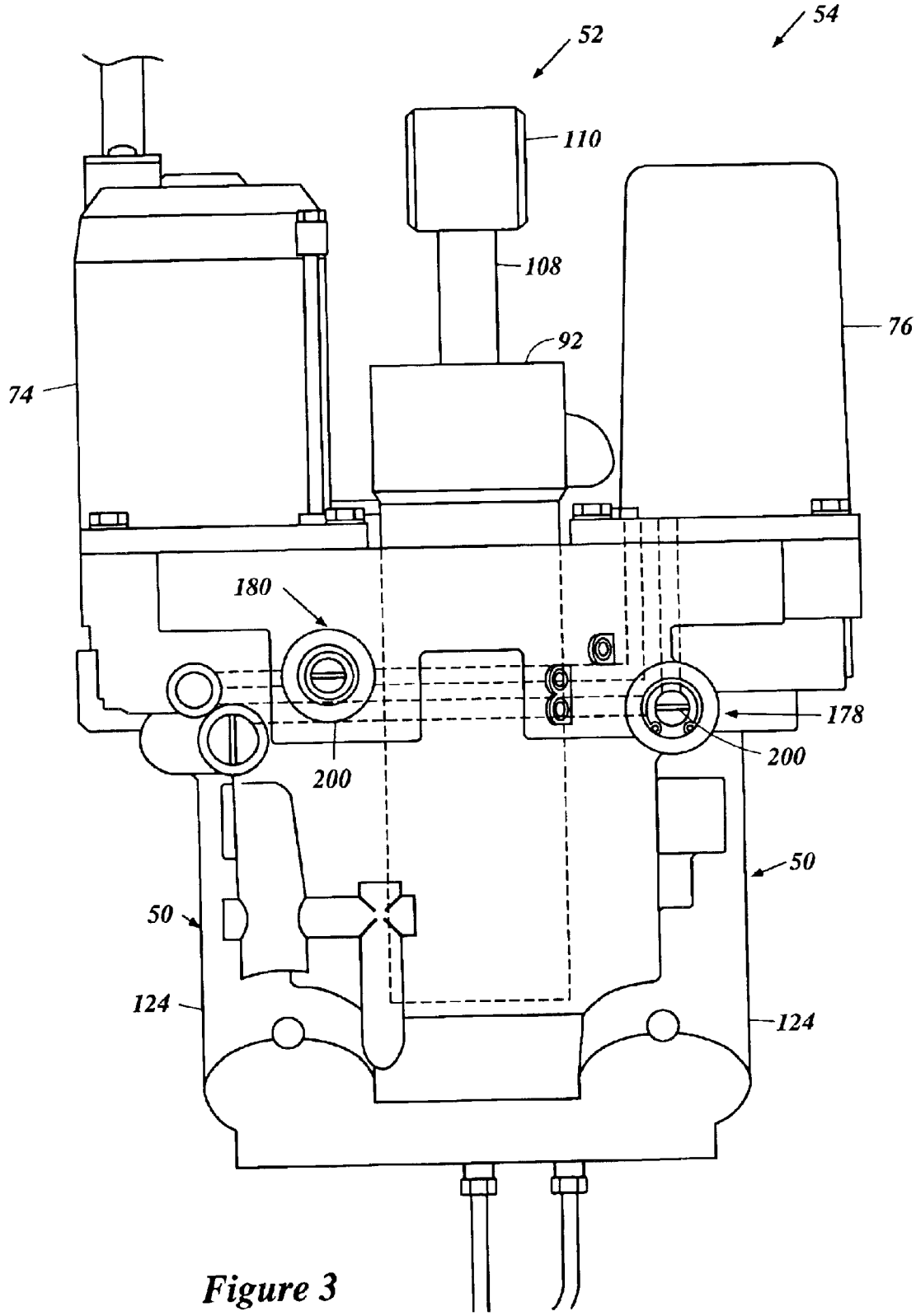
FIG. 3 is a front elevational view of a hydraulic tilt and trim adjustment system applied to the outboard motor.
Figure 4:
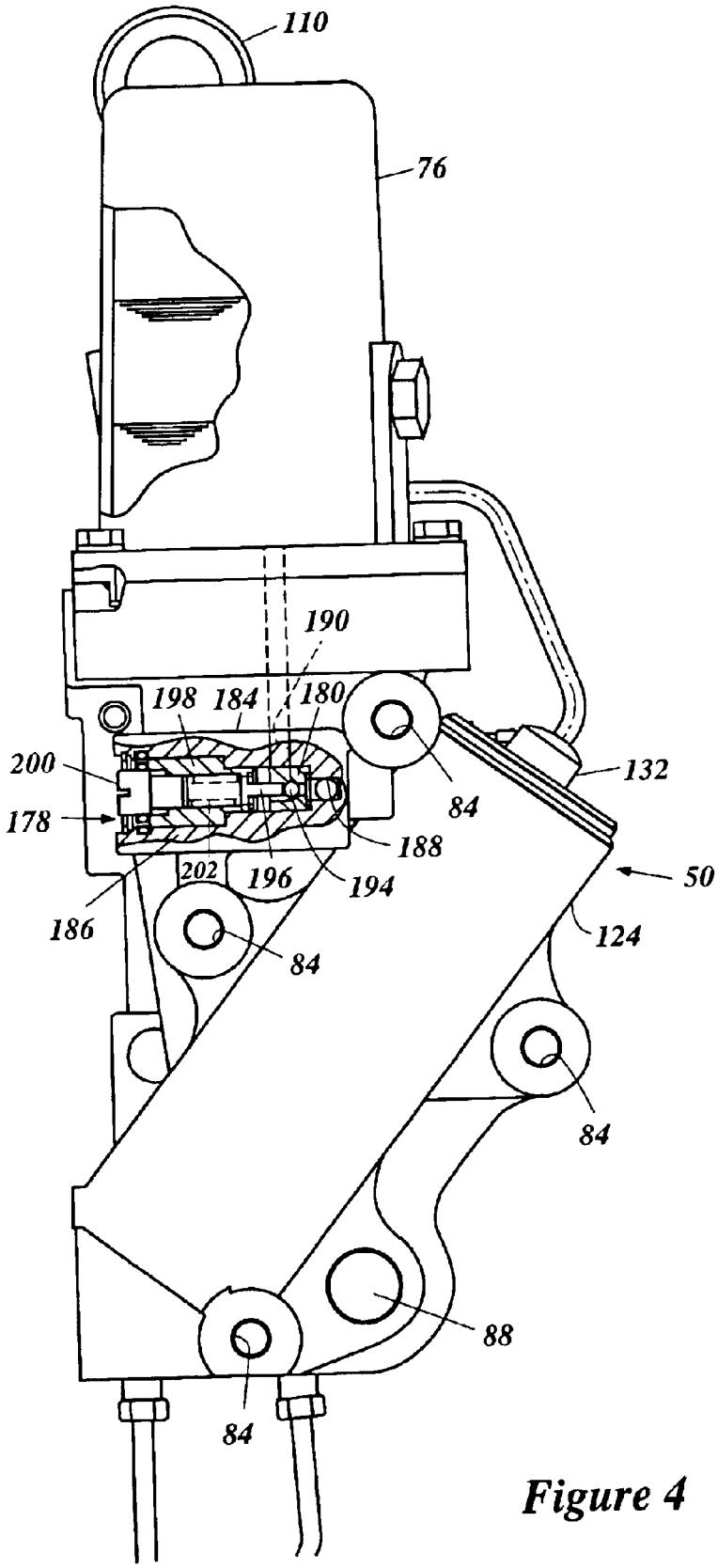
FIG. 4 is a side elevational view of the hydraulic tilt and trim adjustment system of FIG. 3 and illustrates an adjustable relief valve of the system.

With reference to FIGS. 2–4, the hydraulic tilt and trim adjustment system 54 preferably is disposed between the swivel bracket 42 and the clamping bracket 44 to tilt the swivel bracket 42 and the drive unit 32 relative to the clamping bracket 44. The hydraulic tilt system 54 generally nests between the respective bracket arms 44*a*, 44*b* of the clamping bracket 44. The hydraulic tilt and trim adjustment system 54 has particular utility in the context of an outboard motor, and thus is described in the context of an outboard motor. The hydraulic tilt system 54, however, can be used with other types of marine propulsion devices such as, for example, inboard/outboard motors.

The hydraulic tilt system 54 preferably comprises at least one fluid pump unit 74 and at least one fluid reservoir 76 in addition to the trim cylinder units 50 and the tilt cylinder unit 52. The illustrated fluid pump unit 74 comprises a fluid pump 78 (FIG. 6) and an electric motor 80 that drives the fluid pump 78. The trim cylinder units 50, the tilt cylinder unit 52, the fluid pump unit 74 and the fluid reservoir 76 preferably are combined together into an assembly, which may be generally indicated by the same reference numeral 54 as the hydraulic system in this description. The tilt cylinder unit 52, however, preferably is pivotally coupled with a body of the assembly 54.

With reference to FIG. 4, the hydraulic tilt system 54 preferably has four through-holes 84. Four bolts extend through apertures formed in the bracket arms 44*a*, 44*b* and the through-holes 84. Four nuts are fastened onto the ends of the respective bolts. Thus, the hydraulic tilt system 54 is rigidly affixed to the clamping bracket 44 with the tilt cylinder unit 52 pivotally coupled to a portion of the system 54.

With particular reference to FIGS. 3 and 4, the tilt cylinder unit 52 extends generally vertically in a center of the hydraulic tilt assembly 54 such that a center axis of the tilt cylinder unit 52 is disposed generally on or close to a center plane of the outboard motor 30. The center plane preferably extends generally vertically and includes the steering axis. A lower end portion of the tilt cylinder unit 52 preferably is pivotally affixed to the hydraulic tilt assembly 54. The illustrated tilt cylinder unit 52 defines an aperture at the lower end portion and a pivot shaft 88 (FIG. 4) transversely extends therethrough. The bracket arms 44*a*, 44*b* and the body of the hydraulic tilt assembly 54 support the pivot shaft 88. The lower end of the tilt cylinder unit 52 thus is affixed to both the clamping bracket 44 and the body of the tilt assembly 54 for pivotal movement about an axis of the pivot shaft 88 that extends generally horizontally.

The trim cylinder units 50 are disposed on both sides of the tilt cylinder unit 52 and preferably do not pivot relative to the body of the tilt assembly 54. In the illustrated embodiment, the trim cylinder units 50 are generally inclined rearwardly relative to the tilt cylinder unit 52 as shown in FIG. 4.

The pump unit 74 and the fluid reservoir 76 also are disposed on the opposite sides of the tilt cylinder unit 52. The pump unit 74 preferably is positioned on the starboard side (left-hand side of FIG. 3) relative to the center plane of the outboard motor 30. The fluid reservoir 76 preferably is positioned on the port side (right-hand side of FIG. 3) relative to the center plane of the outboard motor 30.

With continued reference to FIGS. 2 and 3 and with additional reference to FIG. 6, the hydraulic tilt and trim adjustment system (assembly) will be described in greater detail below. The tilt cylinder unit 52 preferably comprises a tilt cylinder 92, a tilt piston 94 and a floating piston 96. The tilt cylinder 92 defines an inner cavity. The tilt piston 94 and the floating piston 96 are slidably disposed within cavity. The floating piston 96 normally slides in the cavity with the tilt piston 94 and forms a piston unit 98 together with the tilt piston 94. The piston unit 98 normally divides the internal cavity of the tilt cylinder 92 into first and second chambers 100, 102. In this arrangement, the first chamber 100 is positioned lower than the second chamber 102. On occasion, which will be described below, the tilt piston 94 and the floating piston 96 together define a third chamber 104 therebetween.

A piston rod 108 extends from the tilt piston 94 through the second chamber 102 and outwardly beyond one end of the tilt cylinder 92. In the illustrated arrangement, the piston rod 94 extends upwardly beyond an upper end of the tilt cylinder 92. The piston rod 94 has a boss 110 at a top end thereof. A pivot shaft (not shown) transversely extends through the boss 110 and is supported by an upper portion of the swivel bracket 42. The piston rod 94 thus is affixed to the swivel bracket 42 for pivotal movement about an axis of the pivot shaft and relative to the swivel bracket 42. In other words, the swivel bracket 42 is pivotal relative to the piston rod 108.

The first and second chambers 100, 102 are filled with a working fluid such as, for example, hydraulic oil. The fluid in the first and second chamber 100, 102 is selectively pressurized by the fluid pump 78 through first and second fluid passages 114, 116, respectively. That is, the fluid pump 78 preferably is a reversible pump and has first and second ports 117, 118 which can selectively be an inlet port or an outlet port in accordance with a rotational direction of the fluid pump. In the illustrated arrangement, the first chamber 100 of the tilt cylinder 92 is connected to the first port 117 of the fluid pump 78 through the first fluid passage 114, while the second chamber 102 of the tilt cylinder 92 connected to the second port 118 of the fluid pump 78 through the second fluid passage 116. A gear pump preferably forms the fluid pump 78. The electric motor 80, which also is reversible, can drive the fluid pump 78 in both directions under control of a control device that is operable by the watercraft operator. A switch for controlling the electric motor 80 preferably is disposed at a cockpit of the watercraft.

The piston unit 98 moves upwardly (toward the right-hand side of FIG. 6) when the first chamber 100 is pressurized. With this upward movement of the piston unit 98, the piston rod 108 lifts the swivel bracket 42. The drive unit 32 thus is raised together with the swivel bracket 42. On the other hand, the piston unit 98 moves downwardly (toward the left-hand side of FIG. 6) when the second chamber 102 is pressurized. With this downward movement of the piston unit 98, the piston rod 108 pulls down the swivel bracket 42. The drive unit 32 together with the swivel bracket 42 lowers, accordingly.

The fluid in the second chamber 102 can generally be used to fill an increased volume in the first chamber 100 that occurs when the piston unit 98 moves upward. However, a certain amount of fluid needs to be supplemented in order to compensate for the volume in the second chamber 102 that the piston rod 108 occupies. The supplemental amount of the fluid is supplied to the first passage 114 from the fluid reservoir 76 through a check valve 120 that allows the fluid to flow to the first passage 114 from the reservoir 76 and inhibits the fluid from flowing to the reservoir 76.

Each trim cylinder unit 50 preferably comprises a trim cylinder 124 and a trim piston 126. The trim cylinder 124 defines an inner cavity and the trim piston 126 is slidably disposed within cavity. The trim piston 126 normally divides the internal cavity of the trim cylinder 124 into first and second chambers 128, 130. In the illustrated arrangement, the first chamber 128 is positioned lower than the second chamber 130. A piston rod 132 extends from each trim piston 126 through the second chamber 130 and outwardly beyond an upper end of the trim cylinder 124. Top ends of the respective piston rods 132 abut a front surface of the swivel bracket 42. The piston rods 132 thus lift the swivel bracket 42 when the pistons 126 move upwardly within the respective trim cylinders 124. The first and second chambers 128, 130 are filled with the working fluid.

The respective first chambers 128 of the trim cylinder units 128 are connected to the first fluid passage 114 in series. The fluid pump 78 thus pressurizes the fluid in the first chambers 128 through the first fluid passage 114. The fluid pump 78 draws fluid from the reservoir 76 through the check valve 120 in order to increase the amount of fluid in the first chambers 128. As a result of this process, the piston rods 132 extend from the trim cylinders 124 to lift the swivel bracket 42.

The respective second chambers 130 of the trim cylinder units 128 are connected to the fluid reservoir 76. A check valve 136 and a relief valve 138 are disposed between the second chambers 130 and the fluid reservoir 76 in a passage 139 connecting the second chambers 130 and the fluid reservoir 76. The check valve 136 allows the fluid in the reservoir 76 to move to the second chambers 130 and inhibits the fluid in the second chambers 130 from moving to the reservoir 76. Thus, the fluid is supplied to the second chambers 130 from the fluid reservoir 76 through the passage 139 when the piston rods 132 retract into the trim cylinders 24 and when the fluid in the first chambers 128 cannot move to the second chambers 130. The relief valve 138 allows the fluid in the second chambers 130 to move to fluid reservoir 76 and inhibits the fluid in the reservoir 76 from moving to the second chambers 130. The relief valve 138 is slightly biased by a biasing member. A bias force of the relief valve 138 will be described below.

In the illustrated arrangement, an inner diameter of each trim cylinder 124 is larger than an inner diameter of the tilt cylinder 92. Accordingly, an outer diameter of each trim piston 126 is larger than an outer diameter of the piston unit 98 of the tilt cylinder unit 52.

The hydraulic tilt system 54 preferably comprises a shuttle valve unit 142 to keep the piston unit 98 of the tilt cylinder unit 52 at any position in the tilt cylinder 92 unless the fluid pump 78 pressurizes either the first or second chamber 100, 102. The shuttle valve unit 142 is disposed in the first and second fluid passages 114, 116.

The shuttle valve unit 124 preferably comprises a shuttle cylinder 146, a shuttle piston 148 and a pair of first and second shuttle valves 150, 152. The shuttle cylinder 146 defines an internal cavity. The shuttle piston 148 is slidably disposed within the shuttle cylinder 146 and divides the cavity into a first shuttle chamber 154 and a second shuttle chamber 156. Also, the shuttle piston 148 has rods 158 extending from both sides of the piston 148 toward the first and second shuttle valves 150, 152. The first fluid passage 114 communicates with the first shuttle chamber 154, while the second fluid passage 116 communicates with the second shuttle chamber 156. The first shuttle valve 150 normally disconnects the first shuttle chamber 154 from the first chamber 100 of the tilt cylinder 92. That is, a biasing member such as, for example, a spring, urges the first shuttle valve 150 to close the first shuttle chamber 154. In a similar manner, the second shuttle valve 152 normally disconnects the second shuttle chamber 156 from the second chamber 102 of the tilt cylinder 92. Thus, the fluid in the first chamber 100 and the fluid in the second chamber 102 both are prevented from moving to the fluid pump 78 and the reservoir 76 through the shuttle valve unit 124.

The first shuttle valve 150 opens when the fluid pump 78 pressurizes the fluid in the first fluid passage 114. The fluid moves to the first chamber 100 of the tilt cylinder 92 and to the first chamber 128 of the trim cylinder 124. Simultaneously, the shuttle piston 148 moves toward the second shuttle valve 152 because the pressure in the first shuttle chamber 154 increases. The rod 158 extending toward the second shuttle valve 152 thus opens the second shuttle valve 152 and the fluid in the second chamber 102 of the tilt cylinder 92 is allowed to move to the fluid pump 78. The piston unit 98 moves upwardly to raise the drive unit 32.

The second shuttle valve 152 opens when the fluid pump 78 pressurizes the fluid in the second fluid passage 116. The fluid moves to the second chamber 102 of the tilt cylinder 92. Simultaneously, the shuttle piston 148 moves toward the first shuttle valve 150 because the pressure in the second shuttle chamber 156 increases. The rod 158 extending toward the first shuttle valve 150 thus opens the first shuttle valve 150 and the fluid in the first chamber 100 of the tilt cylinder 92 is allowed to move to the fluid pump 78. The piston unit 98 moves downwardly to lower the drive unit 32.

The hydraulic tilt system 54 also preferably comprises a manual valve 162 to allow the operator to manually lift or lower the drive unit 32. The manual valve 162 connects the first and second fluid passages 114, 116 to the fluid reservoir 76 and is normally closed. A check valve 164 is disposed between the manual valve 162 and the first fluid passage 114. Also, another check valve 166 is disposed between the manual valve 162 and the second fluid passage 116. With the manual valve 162 opened, the check valves 164, 166 allow the fluid in first or second fluid passage 114, 116 to move to the fluid reservoir 76 and inhibit the fluid in the reservoir 76 from moving to the first or second fluid passage 114, 116. The check valves 164, 166 also inhibit fluid flow between the first and second fluid passage 114, 116 through the passages that connect each fluid passage 114, 116 to the reservoir 76.

The hydraulic tilt system 54 additionally comprises a check valve 168 in a fluid passage that connects the first fluid passage 114 and the fluid reservoir 76. The check valve 168 allows the fluid in the reservoir 76 to move to the first fluid passage 114 and inhibits the fluid in the first fluid passage 114 from moving to the first fluid passage 114.

When the operator opens the manual valve 162 and lifts the drive unit 32, the fluid in the second chamber 102 of the tilt cylinder 92 moves toward the fluid reservoir 76 through the check valve 166 and the fluid in the reservoir 76 moves toward the first chamber 100 of the tilt cylinder 92 through the check valve 168. In addition, if the drive unit 32 is positioned in the trim range, the fluid in the second chambers 130 of the trim cylinders 124 moves toward the fluid reservoir 76 through the relief valve 138 because the preset pressure of the relief valve 138 is small so as to open when the drive unit 32 is lifted. Also, the fluid in the reservoir 76 moves toward the first chambers 128 through the check valve 168.

When the operator lowers the drive unit 32, with the manual valve 162 opened, the fluid in the first chamber 100 moves toward the fluid reservoir 76 through the check valve 164 and the fluid in the reservoir 76 moves toward the second chamber 100 through the check valve 120. In addition, if the drive unit 32 is positioned in the trim range, the fluid in the first chambers 128 of the trim cylinders 124 moves toward the fluid reservoir 76 also through the check valve 164 and the fluid in the reservoir 76 moves toward the second chambers 130 through the check valve 136 and the fluid passage 139. Thus, the drive unit 32 can be held at any position whenever the manual valve 162 is closed. The manual valve 162 can also be operated when the working fluid is removed from the hydraulic tilt system 54.

The hydraulic tilt system 54 preferably comprises a shock absorber or pop-up mechanism to protect the drive unit 32 when the drive unit 32 strikes an obstacle such as, for example, driftwood. The shock absorber in this arrangement comprises an absorber valve 172 and a check valve 174 both arranged in the tilt piston 174 of the tilt cylinder 92. The absorber valve 172 allows the fluid in the second chamber 102 to flow into the third chamber 104, i.e., the chamber defined between the tilt piston 94 and the floating piston 96, and to inhibit the fluid in the third chamber 104 from moving to the second chamber 102. The absorber valve 172 is biased by a biasing member such as, for example, a spring. The bias force, i.e., preset pressure, is set relatively large such that the absorber valve 172 does not open unless the drive unit 32 strikes a relatively heavy obstacle. For example, the bias force is large enough such that the absorber valve 172 does not open when the watercraft is propelled in reverse. The check valve 174, in turn, allows the fluid in third chamber 104 to flow into the second chamber 102 and inhibits the fluid in the second chamber 102 from moving to the third chamber 104.

When the drive unit 32 strikes a floating or underwater object, such as, for example, driftwood, the absorber valve 172 opens to allow some of the fluid in the second chamber 102 to move to the third chamber 104. The tilt piston 94 moves upwardly (toward the right-hand side of FIG. 6) in the tilt cylinder 92 to lift the drive unit 32 upwardly. The floating piston 96 stays at its own position because the fluid in the first chamber 100 does not move out of the chamber 100. After the drive unit 32 has cleared the driftwood, the drive unit 32 falls back under its own weight. The fluid in the third chamber 104 returns to the second chamber 102 through the check valve 174 and the tilt piston 94 moves back to its initial position.

A volumetric discrepancy between the second and third chambers 102, 104 occurs during the discussed shock absorbing process. That is, for a given travel of the piston 94, the resulting volume within the third chamber 104 is larger than a corresponding volume in the second chamber 102 due to the volume occupied by the piston rod 108 in the second chamber 102; however, a cavitation phenomenon occurs in the third chamber 104 because the pressure in the third chamber 104 falls. Bubbles appear in the fluid to fill the larger third chamber 104.

The fluid in the first chamber 100 can build to a high pressure when the piston unit 98 reaches the top of the tilt cylinder 92 during the tilt up movement if the fluid pump 78 continuously operates thereafter. Similarly, the fluid in the second chamber 102 can build to a high pressure; however, this can happen before the piston unit 98 reaches the bottom of the tilt cylinder 92 in this arrangement. In order to relieve high pressures in the first and second chambers 100, 102, the hydraulic tilt system 54 comprises first and second relief valves 178, 180, respectively.

The first relief valve 178 connects the first fluid passage 114 to the fluid reservoir 76. In the illustrated arrangement, the relief valve 138 is disposed between the first relief valve 178 and the fluid reservoir 76. The first relief valve 178 allows the fluid in the first fluid passage 114 to move to the fluid reservoir 76 and inhibits the fluid in the fluid reservoir 76 from moving to the first fluid passage 114. A preset pressure of the first relief valve 178 is set considerably larger than the preset pressure of the second relief valve 138. That is, the preset pressure of the second relief valve 138 is determined, in addition to the foregoing condition, to keep the second relief valve 138 closed when a thrust force that backwardly propels the watercraft in a slow speed affects the drive unit 32 to inhibit the drive unit 32 from moving upwardly.

The second relief valve 180, in turn, connects the second fluid passage 116 to the fluid reservoir 76. The check valve 138 also is disposed between the second relief valve 178 and the fluid reservoir 76 in this arrangement. The second relief valve 180 allows the fluid in the second fluid passage 116 to move to the fluid reservoir 76 through the relief valve 138 and to the second chambers 130 of the trim cylinders 124 through the fluid passage 139. The second relief valve 180 also inhibits the fluid in the fluid reservoir 76 from moving to the second fluid passage 116. A preset pressure of the second relief valve 180 also is set considerably larger than the preset pressure of the relief valve 138.

The preset pressure of the first relief valve 178 preferably is determined such that the first relief valve 178 does not open under the pressure that the fluid pump 78 normally builds (i.e., the relief valve 178 regulates the maximum output pressure of the fluid pump 78) and under a pressure built during trim movement. The preset pressure of the first valve 178, however, desirably is selected to allow the first valve 178 to open under the pressure built when the piston unit 98 has reached the top end of the tilt cylinder 92 and under a pressure built when a downward force on the piston unit 98 when in the tilt range (i.e., above the trim range) is abnormally large, e.g., when a thrust force on the system is larger than a designed maximum thrust force (that is, a preset force) specified for operation in the tilt range.

This last condition varies in accordance with the properties of the associated watercraft and the outboard motor 30. That is, the preset pressure depends on the size of the watercraft and the horsepower of the outboard motor 30, for example. The thrust force can change in response to an engine speed of each specific outboard motor. The present arrangement allows the preset pressure to be adjusted to account for these variables and permit the system to be used with a wide variety of types and sizes of outboard motors and watercraft.

The preset pressure of the second relief valve 180, which is also adjustable, is determined such that the second relief valve 180 does not open under the pressure built by the normal operation of the fluid pump 78 and opens under the pressure built during the trim movement.

Structure of Relief Valve

Figure 5:
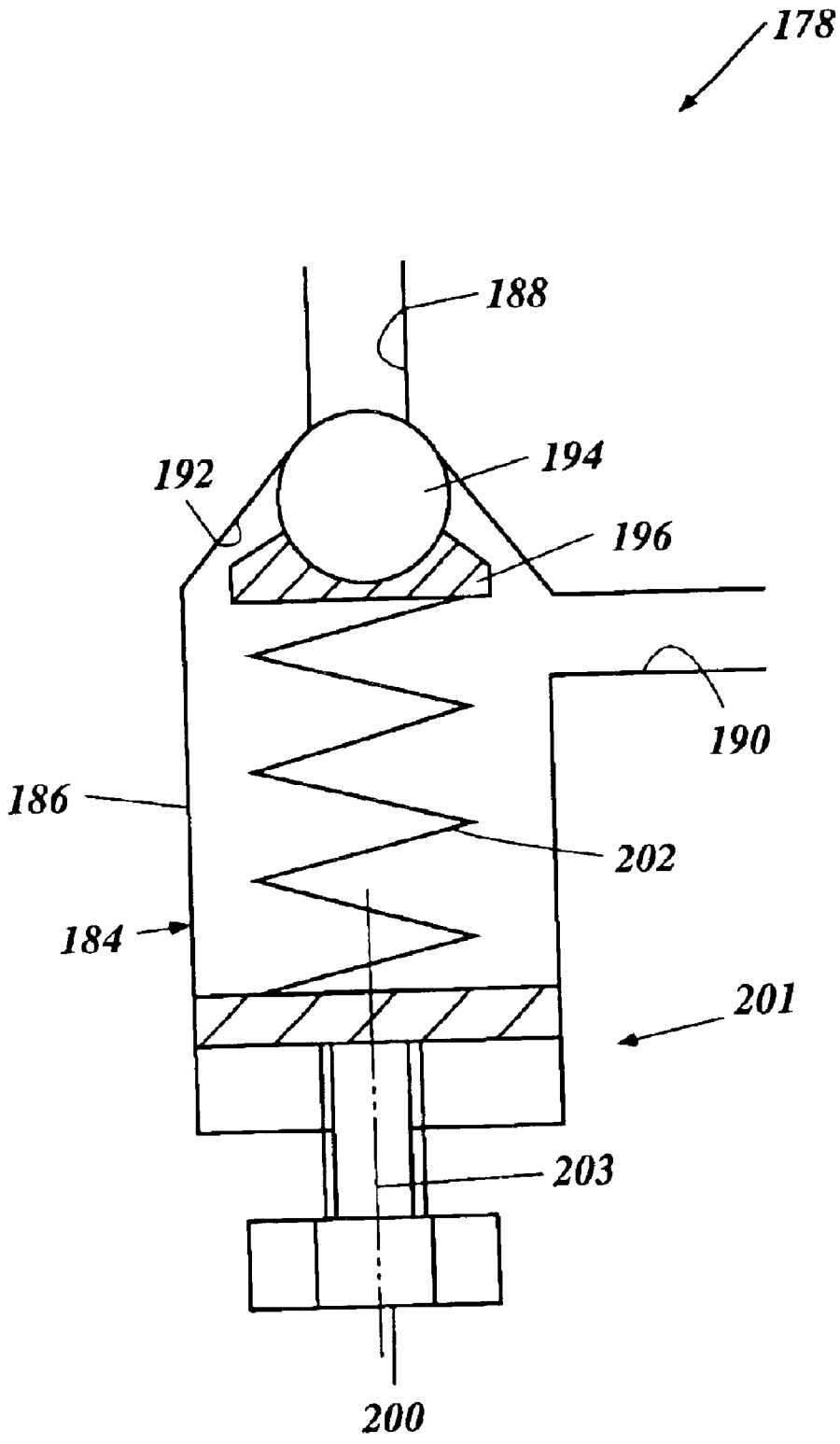
FIG. 5 is a schematic illustration of several of the components of the adjustable relief valve shown in FIG. 4.

With reference to FIGS. 4 and 5, a structure of the first relief valve 178 that can adjust the preset pressure will be described below. A structure of the second relief valve 180 preferably is the same as the structure of the first relief valve 178. Accordingly, the following description of the first relief valve 178 will apply equally to describe the second relief valve 180.

A valve housing 184 of the relief valve 178 incorporates a retainer member 186 that has an aperture. The aperture communicates with a passage 188 that is defined in the housing 184 and is connected to the first fluid passage 114. The aperture also communicates with another passage 190 that is also defined in the housing 184 and is connected to the fluid reservoir 76. The retainer member 186 additionally defines a valve seat 192 (FIG. 5) and a ball valve 194 is seated at the valve seat 192.

As best seen in FIG. 4, push rod 196 is slidably disposed within the aperture. A cylindrical member 198 also supports the push rod 196 such that a head portion of the push rod 196 is slidable in the cylindrical member 198. The cylindrical member 198 defines an internal thread. An adjustment screw 200 is joined with the internal screw. The screw 200 and the cylindrical member 198 that has the internal screw form an adjustment mechanism 201 in the illustrated arrangement.

A bias member 202, which preferably is a coil spring, is interposed between the head portion of the push rod 196 and the screw 200 and urges the push rod 196 toward the ball valve 194. A center axis 203 (FIG. 5) of the screw 200 is generally consistent with a center axis of the spring 202. The ball valve 194 normally resides in its closed position and disconnects the reservoir passage 190 from the delivery passage 188. The relief valve 178 will not open until a pressure develops in the delivery passage 188 (and also in the first fluid passage 114) that exceeds the preset pressure. The preset pressure corresponds to a biasing force of the bias member 202, e.g., the spring. That is, the relief valve 168 opens when a pressure that overcomes the biasing force of the spring 202 is built in the first fluid passage 114. The preset pressure, e.g., the biasing force of the spring 202, is adjusted by operating the screw 200 back and forth because the bias spring 202 expands or contracts when the screw 200 moves axially. In this manner, the illustrated hydraulic tilt system 54 does not require various types of relief valves in order to be adjusted to work with various types of watercrafts and outboard motors.

With reference to FIGS. 2–4, the respective screws 200 of the first and second relief valves 178, 180 preferably are positioned at a front surface of the hydraulic tilt assembly 54. The screws 200 are visible and can be accessed between the bracket arms 44*a*, 44*b*, as shown in FIG. 2. The position of the screw thus can be easily accessed and adjusted when the outboard motor is apart from the watercraft (e.g., at the assembly plant or when being repaired). The position of the screw, however, cannot be adjusted after the outboard motor 30 is mounted on an associated watercraft because the front surface of the tilt assembly 54 is covered by the transom of the watercraft. This arrangement thus prevents the preset pressure of the relief valves 178, 180 from being changed after the outboard motor is mounted on the watercraft.

Operation of Hydraulic Tilt and Trim Adjustment System

Figure 6:
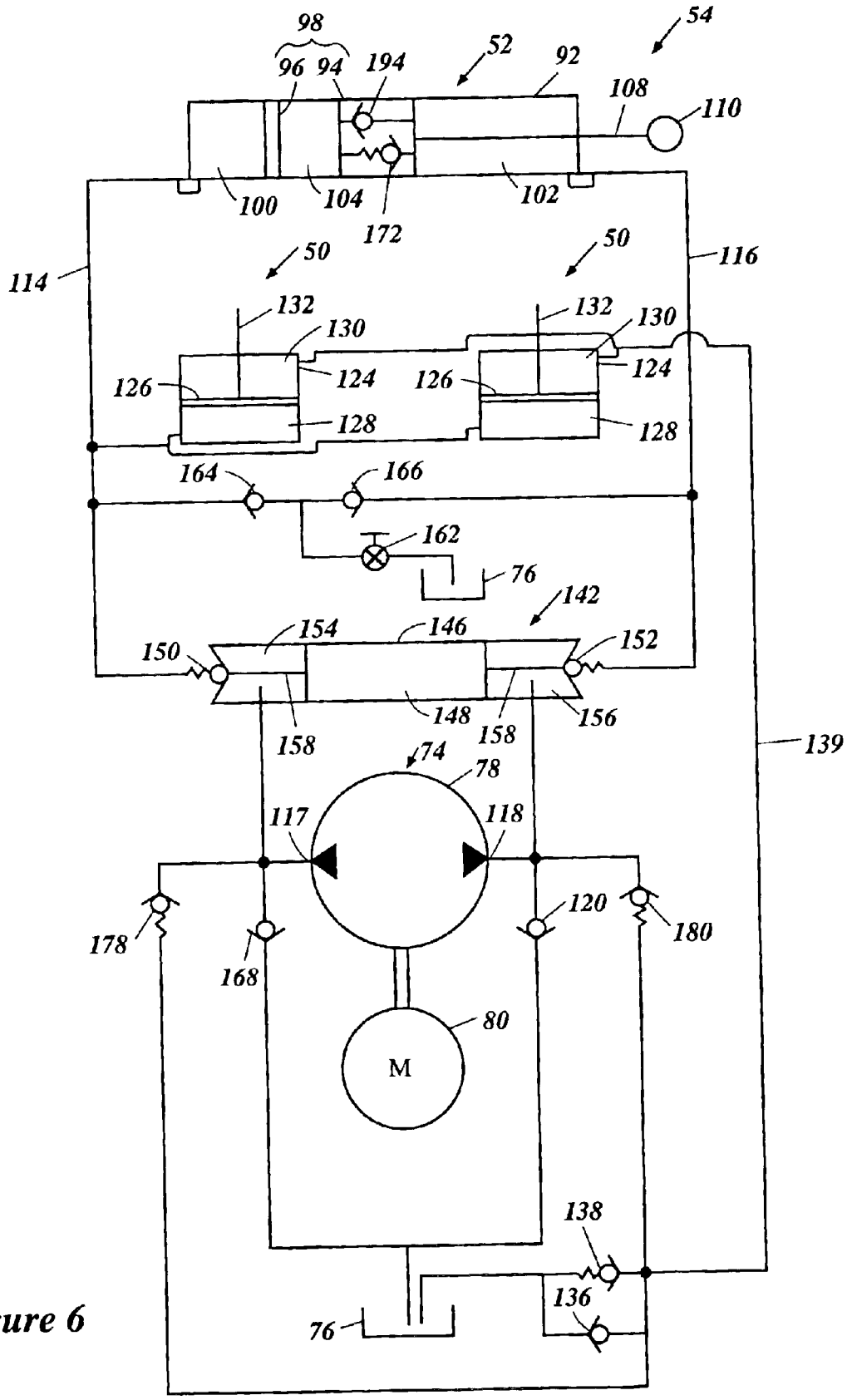
FIG. 6 is a hydraulic circuit diagram of the tilt and trim adjustment system. To simplify the circuit diagram, a reservoir (76) of the hydraulic tilt and trim adjustment system is illustrated at two locations on the diagram; however, in the illustrated embodiment, the hydraulic tilt and trim adjustment system has only one reservoir.

With particular reference to FIG. 6, initially, the piston unit 98 is positioned at the bottom of the tilt cylinder 92 and also the trim pistons 126 are positioned at the bottom of the respective trim cylinders 124. The fluid pump 78 starts pressurizing the fluid in the first fluid passage 114 when the operator operates the switch of the electric motor 80. The first shuttle valve 150 opens and the fluid flows to the first chamber 100 of the tilt cylinder 92 and also to the first chambers 128 of the trim cylinders 124. Simultaneously, the rod 158 of the shuttle piston 148 opens the first shuttle valve 152 and the fluid in the second chamber 102 of the tilt cylinder 92 moves toward the fluid pump 78 through the second fluid passage 116. The relief valve 138 also opens and the fluid in the second chambers 130 of the trim cylinders 124 moves toward the fluid reservoir 76. In addition, the check valve 120 opens to allow the pump 78 to draw additional fluid from the reservoir 76 to adequately pressurize the fluid in the first chamber 100 of the tilt cylinder 92.

Under this operation, the piston rod 108 of the tilt cylinder unit 52 and the piston rods 132 of the trim cylinder units 50 together lift the drive unit 32 with the swivel bracket 42. The trim cylinder units 50 primarily lift the drive unit 32 until the trim pistons 126 reach the top ends of the trim cylinders 124, i.e., in the trim range, because the inner diameter of each trim cylinder 128 is larger than the inner diameter of the tilt cylinder 92.

If the operator wants to run the watercraft at a relatively high speed, the operator stops the fluid pump 78 in the trim range. The operator accelerates the engine operation and the watercraft easily gathers speeds for the high speed running because the bow of the watercraft is slightly lifted up (i.e., inclined upwardly) when the drive unit is raised within the trim range (i.e., is trimmed-up).

If the operator does not stop the fluid pump 78 in the trim range, but rather allows the fluid pump 78 to operate into the tilt range and accelerates the engine operation, a large pressure is built in the first chamber 100 of the tilt cylinder 92 because the trim cylinder units 50 no longer support the drive unit 32 in the tilt range and the tilt cylinder unit 52 counters the thrust force of the propeller 70 as well as lifts the weight of the outboard motor. Under this condition, the first relief valve 178 opens when the engine speed becomes greater than a certain speed that is specific to the particular outboard motor 30. The large pressure in the first chamber 100 thus affects the first relief valve 178. If the large pressure exceeds the preset pressure of the first relief valve 178, then the relief valve 178 opens to relieve the pressure, i.e., to allow the fluid in the first chamber 100 to move toward the fluid reservoir 76. The relief valve 138 also opens under this condition and allows the fluid to move to the fluid reservoir 76. The drive unit 32 thus will automatically lower back to the trim range if the operator attempts to increase significantly engine speed while tilting up the outboard motor 30 (i.e., while operating the pump 78 in an attempt to move the outboard motor 30 in the tilt range).

If the operator wants the drive unit 32 slightly lifted into the tilt range from the trim range when the watercraft advances through shallow waters, the operator stops the fluid pump 78 and keeps the engine operation at a slow speed. The first relief valve 178 will not open under this condition because the first shuttle valve 150 is in the closed position. The tilt cylinder unit 52 thus supports the drive unit 32 in this tilt position.

If the operator wants the drive unit 32 fully lifted when the watercraft has arrived at a harbor or the like, for example, the operator continuously operates the fluid pump 78 in the tilt range. The first chamber 100 is pressurized and the piston unit 98 moves upwardly. The fluid in the second chamber 102 moves toward the first chamber 100 through the shuttle piston unit 142 and the fluid pump 78. A make-up amount of the fluid is supplemented from the fluid reservoir 76 through the check valve 120 as described above. Then, the piston unit 98 reaches the top end of the tilt cylinder 92. The fluid pump 78 can still operates even after the piston unit 98 has reached the top end unless the operator turns off the switch of the electric motor 80.

A large pressure therefore can occur in the first chamber 100 and at the first port 117 of the fluid pump 78 under this condition. The first relief valve 178 opens because the pressure is larger than the preset pressure of the first relief valve 178. The relief valve 138 also opens under the condition and allows the fluid to move toward the fluid reservoir 76. Fluid thus is allowed to drain to the fluid reservoir 76. The pressure in the first chamber 100 thus is relieved and preferably will not be larger than the preset pressure of the relief valve 178 even if the fluid pump 78 continues to operate after the tilt piston has reached the end of its stroke. In addition, the check valve 120, the first relief valve 178 and the relief valve 138 together allow the fluid to circulate between the fluid pump 78 and the fluid reservoir 76. This arrangement reduces stresses on the system and, especially, on the tilt cylinder unit 52 and the fluid pump 78.

If the operator wants the drive unit 32 lowered, the operator operates the switch of the electric motor 80 such that the electric motor 80 drives the fluid pump 78 in the reversed direction. The fluid pump 78 pressurizes the fluid in the second fluid passage 116. The second shuttle valve 152 opens and the fluid moves to the second chamber 102 of the tilt cylinder 92. Simultaneously, the rod 158 of the shuttle piston 148 opens the first shuttle valve 150 and the fluid in the first chamber 100 of the tilt cylinder 92 moves toward the fluid pump 78 through the first fluid passage 114. The piston unit 98 moves downwardly and pulls the piston rod 108. The drive unit 32 thus is lowered to the trim range.

If the operator wants the drive unit 32 fully lowered down, the operator continuously operates the fluid pump 78 in the trim range. The second chamber 102 of the tilt cylinder 92 is pressurized and the piston unit 98 moves downwardly. The fluid in the first chamber 100 moves toward the second chamber 102 through the shuttle piston unit 142 and the fluid pump 78.

Simultaneously, the piston rods 132 are pressed to retract into the trim cylinders 124 and the trim pistons 126 thus move downwardly. The fluid in the first chambers 128 of the trim cylinders 124 moves toward the second chamber of the tilt cylinder 92 through the shuttle piston unit 142 and the pump 78 because the fluid passage 116 is not connected to the second chambers 130 of the trim cylinders 124 but to the second chamber 102 of the tilt cylinder 92. Thus, the pressure in the second chamber 102 and the pressure at the second port 118 of the fluid pump 78 can become large and can exceed the preset pressure of the second relief valve 180. The second relief valve 180 and the relief valve 138 open. The fluid thus moves to the second chambers 130 of the trim cylinders 124 through the second relief valve 180 and the fluid passage 139 and also to the fluid reservoir 76 through the second relief valve 180 and the relief valve 138.

The piston unit 98 reaches the bottom end of the tilt cylinder 92 as the trim pistons 126 are reaching the bottom end of the trim cylinders 124. The fluid pump 78, however, can still operate even after the piston unit 98 has reached the bottom end unless the operator turns off the switch of the electric motor 80. The second relief valve 180 and the relief valve 138 can open or remain open and the excess pressure is relieved by those relief valves 180, 138. Under this operating condition of the tilt and trim adjustment system, fluid circulates between the fluid pump 78 and the fluid reservoir 76 through the check valve 168, the second relief valve 180 and the relief valve 138 to reduce internal stresses on the system.

Modified Structure of Relief Valve

Figure 7:
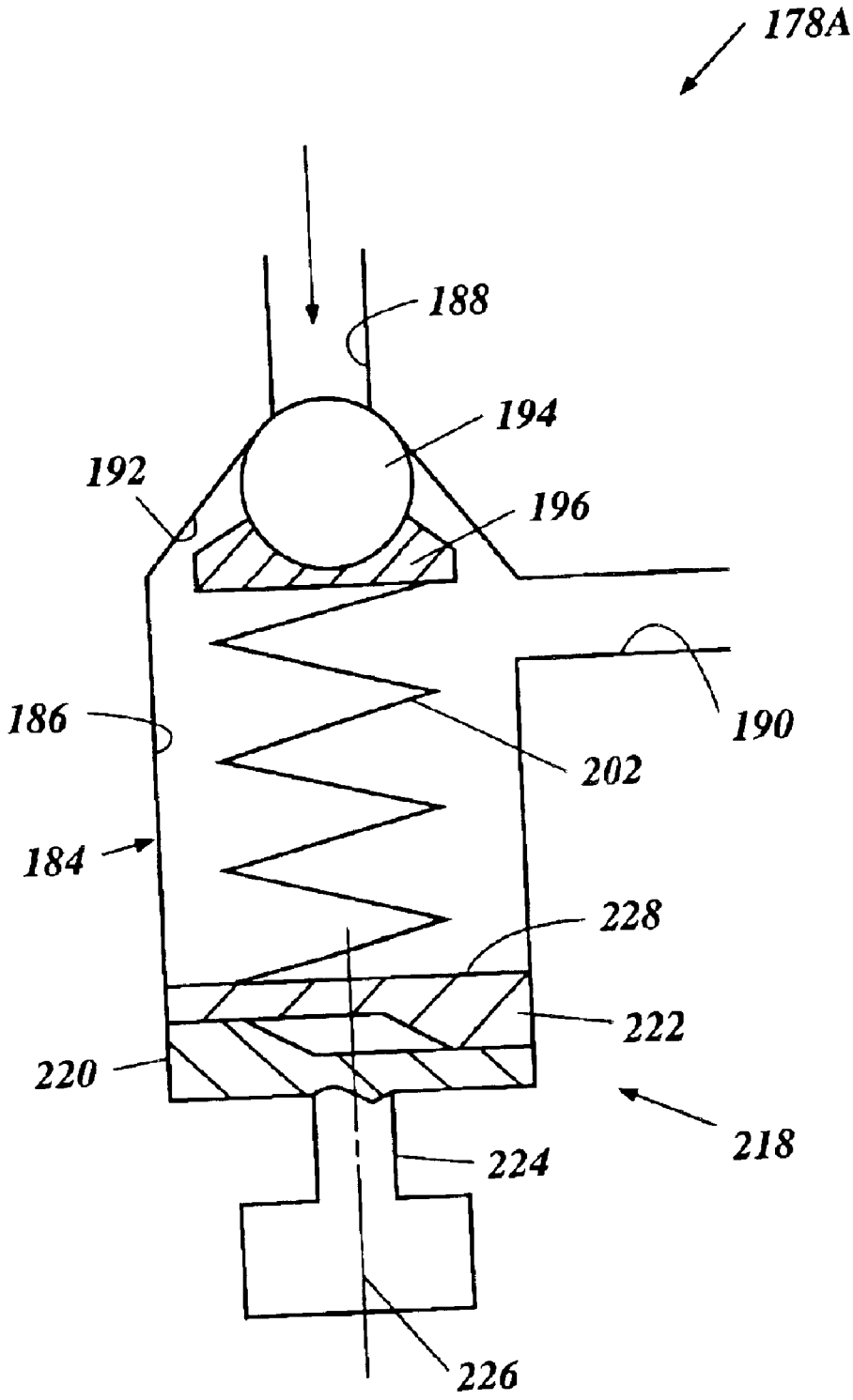
FIG. 7 is a schematic view of another relief valve having a modified adjustment mechanism, which includes a cam and a cam follower and which is configured in accordance with another preferred embodiment of the present invention.

One or both of the first and second relief valves can include other types of adjustment mechanisms. The embodiment of the relief valve illustrated in FIG. 7 and FIGS. 8(*a*), (*b*) and (*c*) is a further example of a type of an adjustable relief valve that can be used with the present hydraulic tilt and trim adjustment system. Apart from the adjustment mechanism, the general structure of the relief valve schematically illustrated in FIG. 7 is similar to the structure of the relief valve described above. Accordingly, in the present embodiment, like reference numerals with an "A" suffix designate like structure, elements between the embodiments and the foregoing description of such structural elements applies equally to the structural elements of this embodiment, unless indicated otherwise.

The relief valve 178A shown in FIG. 7 has a modified adjustment mechanism 218. A combination of a cam 220 and a cam follower 222 forms the modified adjustment mechanism 218 and replaces the combination of the cylindrical member 198 and the screw 200. The cam 220 is affixed to a knob 224 and is pivotable preferably about a center axis 226 of the relief valve 178A at an end of the valve housing 184 opposite to the valve seat 192. The cam follower 222 is interposed between the cam 220 and the bias member, e.g., a biasing spring 202. The bias spring 202 abuts an end surface 228 of the cam follower 222. The cam follower 222 is axially movable along the axis 226 when the cam 220 pivots with the knob 224 operated by the operator. In the illustrated embodiment, an axis of the axial movement of the cam follower 222 generally coincides with the center axis of the spring 202.

Figure 8C:
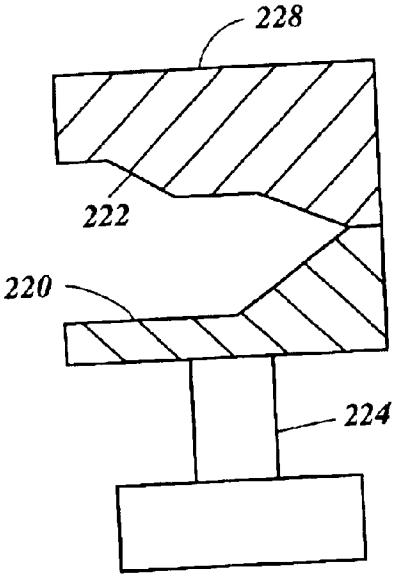
FIGS. 8(*a*), (*b*) and (*c*) are schematic views of the adjustment mechanism of FIG. 7 showing different positions of the adjustment mechanism.
Figure 8B:
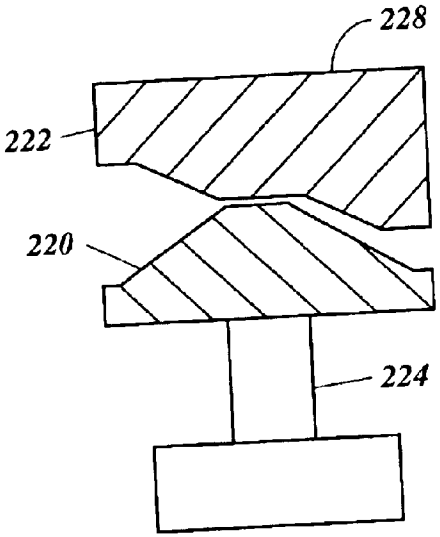
Figure 8A:
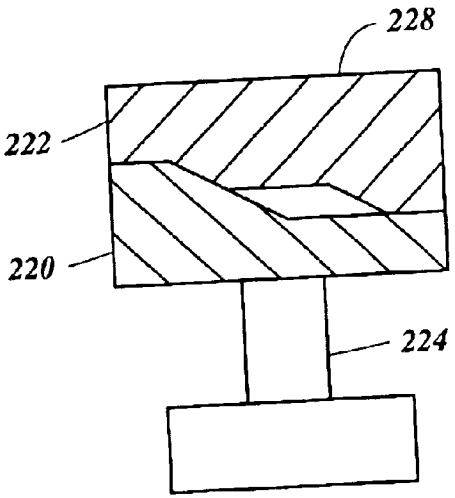

Initially, the end surface 228 is positioned closest to the cam 220 as shown in FIG. 8(*a*). The end surface 228 moves farther from the cam 220 when the cam 220 pivots and the cam follower 222 follows, moving axially as shown in FIG. 8(*b*). The end surface 228 finally reaches the farthest position from the cam 220 as shown in FIG. 8(*c*). The cam follower 222 can be kept at any position between the closest position and the farthest position. The bias spring 202 expands or contracts with axial movement of the cam follower 222. The biasing force of the spring 202 thus is adjustable by operating the cam 220.

As described above, both the illustrated first and second relief valves 178, 180 preferably have the adjustment mechanism 201 (or 218). The second relief valve 180, however, can be fixed. In this regard, the preset pressure of the second relief valve 180 preferably is determined to be relatively large, i.e., to be adapted to a large sized outboard motor.

Additionally, either the absorber valve 172 or the relief valve 180, or both of those valves 172, 180 can have a similar adjustment mechanism.

It should be noted that the boss 110 of the piston rod 108 can be coupled with the clamping bracket 44 and, in this alternative, the tilt cylinder 92 is coupled with the swivel bracket 42. In this variation, the first chamber 100 of the tilt cylinder 92 is positioned above the second chamber 102 and the drive unit 32 is lowered when the first chamber 100 is pressurized.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined by a fair reading of the claims.

What is claimed is:

1. A marine propulsion device comprising a drive unit adapted to be mounted on an associated watercraft for pivotal movement about a tilt axis that extends generally horizontally, a hydraulically operated tilt unit arranged to operate between the drive unit and the watercraft, a fluid pump pressurizing working fluid within the tilt unit, a relief valve commmunicating with the tilt unit so as to relieve the pressure of the working fluid within the tilt unit when the pressure exceeds a preset magnitude, and an adjustment mechanism arranged to adjust the preset magnitude, wherein the adjustment mechanism is formed at a surface of the tilt unit.

2. The marine propulsion device as set forth in claim 1, wherein the tilt unit comprises a tilt cylinder, a piston slidably disposed within the tilt cylinder, the tilt cylinder defines first and second chambers with the piston, the first and second chambers are filled with the working fluid, and a piston rod extending from the piston through the second chamber and outwardly beyond one end of the tilt cylinder, and the relief valve relieves the pressure applied to the working fluid in the first chamber or the second chamber.

3. The marine propulsion device as set forth in claim 2, wherein the tilt unit tilts the drive unit upwardly when the first or second chamber is pressurized, and the relief valve relieves the pressure applied to the working fluid in the first or second chamber.

4. The marine propulsion device as set forth in claim 3, additionally comprising a propulsion device disposed on the drive unit, and a prime mover powering the propulsion device, the propulsion device producing a thrust force onto the drive unit, the first or second chamber being pressurized when the thrust force is applied, and the relief valve being opened to relieve the pressure when the thrust force exceeds a preset force.

5. The marine propulsion device as set forth in claim 4, wherein the thrust force exceeds the preset force when the prime mover drives the device at a speed greater than a preset speed.

6. The marine propulsion device as set forth in claim 2, wherein the adjustment mechanism is configured to set the preset magnitude of pressure lower than the pressure build in the working fluid when the fluid pump continuously pressurizes the working fluid after the piston has reached at either end of the tilt cylinder.

7. The marine propulsion device as set forth in claim 1 additionally comprising a fluid reservoir containing working fluid, the relief valve arranged to allow the working fluid to move toward the fluid reservoir when the pressure applied to the working fluid exceeds the preset magnitude.

8. The marine propulsion device as set forth in claim 1 additionally comprising a fluid passage connecting the tilt unit and the fluid reservoir, the relief valve being disposed within the fluid passage, the relief valve comprising a valve member that closes the fluid passage when the valve member is in a first position, and a biasing member urging the valve member to the first position with a preset bias force, the adjustment mechanism changing the preset bias force.

9. A marine propulsion device comprising a drive unit adapted to be mounted on an associated watercraft for pivotal movement about a tilt axis that extends generally horizonally, a hydraulically operated tilt unit arranged to operate between the drive unit and the watercraft, a fluid pump pressurizing working fluid within the tilt unit, a relief valve communicating with the tilt unit so as to relieve the pressure of the working fluid within the tilt unit when the pressure exceeds a preset magnitude, an adjustment mechanism arranged to adjust the preset magnitude, a fluid passage connecting the tilt unit and the fluid reservoir, the relief valve being disposed within the fluid passage, the relief valve comprising a valve member that closes the fluid passage when the valve member is in a first position, and a biasing member urging the valve member to the first position with a preset bias force, the adjustment mechanism changing the preset bias force, wherein the adjustment mechanism comprises an internal thread formed at a portion of the relief valve on a side opposite to the valve member, and a screw that is joined with the internal thread and abuts against the biasing member, and the bias force of the biasing member is changed when the screw moves back and forth relative to the internal thread.

10. The marine propulsion device as set forth in claim 9, wherein the biasing member is a coil spring, and a center axis of the screw is generally coaxial with a center axis of the coil spring.

11. A marine propulsion device comprising a drive unit adapted to be mounted on an associated watercraft for pivotal movement about a tilt axis that extends generally horizonally, a hydraulically operated tilt unit arranged to operate between the drive unit and the watercraft, a fluid pump pressurizing working fluid within the tilt unit, a relief valve communicating with the tilt unit so as to relieve the pressure of the working fluid within the tilt unit when the pressure exceeds a preset magnitude, an adjustment mechanism arranged to adjust the preset magnitude, a fluid passage connecting the tilt unit and the fluid reservoir, the relief valve being disposed within the fluid passage, the relief valve comprising a valve member that closes the fluid passage when the valve member is in a first position, and a biasing member urging the valve member to the first position with a preset bias force, the adjustment mechanism changing the preset bias force, wherein the adjustment mechanism comprises a cam and a cam follower abutting on the biasing member, the cam follower moves axially when the cam rotates, and the bias force of the biasing member is changed when the cam is operated such that the cam follower moves axially.

12. The marine propulsion device as set forth in claim 11, wherein the biasing member is a coil spring, and an axis of the axial movement of the cam follower is generally coaxial with a center axis of the coil spring.

13. An outboard motor comprising a drive unit and a bracket assembly adapted to be mounted on an associated watercraft, the bracket assembly comprising a swivel bracket arranged to carry the drive unit for pivotal movement about a steering axis, and a clamping bracket arranged to support the swivel bracket for pivotal movement about a tilt axis that lies generally normal to the steering axis, a hydraulically operated tilt unit operating between the swivel bracket and the clamping bracket to tilt the drive unit, a fluid pump arranged to pressurize working fluid within the tilt unit, a relief valve communicating with the tilt unit so as to relieve the pressure of the working fluid when the pressure exceeds a preset magnitude, and an adjustment mechanism arranged to adjust the preset magnitude, wherein the bracket assembly is disposed at a location in front of the drive unit, the adjustment mechanism is formed at a front surface of the tilt unit.

14. The outboard motor as set forth in claim 13, wherein the hydraulically operated tilt unit comprises a tilt cylinder, a piston slidably disposed within the tilt cylinder, the tilt cylinder defines first and second chambers with the piston, the first and second chambers are filled with the working fluid, and a piston rod extending from the piston through the second chamber and outwardly beyond one end of the tilt cylinder, the piston rod is disposed at the swivel bracket or the clamping bracket, another end of the tilt cylinder is disposed at the other of the clamping bracket or the swivel bracket, and the relief valve relieves the pressure applied to the working fluid in the first chamber or the second chamber.

15. The outboard motor as set forth in claim 14, wherein the tilt unit tilts the drive unit upwardly when the first or second chamber is pressurizied, and the relief valve relieves the pressure applied to the working fluid in the first or second chamber.

16. The outboard motor as set forth in claim 15 additionally comprising a propulsion device disposed on the drive unit, and a prime mover powering the propulsion device, the propulsion device producing a thrust force onto the drive unit, the first or second chamber being pressurized when the thrust force is applied, and the relief valve being opened to relieve the pressure when the thrust force exceeds a preset force.

17. The outboard motor as set forth in claim 16, wherein the thrust force exceeds the preset force when the prime mover drives the propulsion device at a speed greater than a preset speed.

18. The outboard motor as set forth in claim 17, wherein the prime mover is an engine, the thrust force changes in response to an engine speed of the engine.

19. An outboard motor comprising a drive unit and a bracket assembly adapted to be mounted on an associated watercraft, the bracket assembly comprising a swivel bracket arranged to carry the drive unit for pivotal movement about a steering axis, and a clamping bracket arranged to support the swivel bracket for pivotal movement about a tilt axis that lies generally normal to the steering axis, a hydraulically operated tilt unit operating between the swivel bracket and the clamping bracket to tilt the drive unit, a fluid pump arranged to pressurize working fluid within the tilt unit, a relief valve communicating with the tilt unit so as to relieve the pressure of the working fluid when the pressure exceeds a preset magnitude, an adjustment mechanism arranged to adjust the preset magnitude, the hydraulically operated tilt unit comprising a tilt cylinder, a piston slidably disposed within the tilt cylinder, the tilt cylinder defining first and second chambers with the piston, the first and second chambers being filled with working fluid, a piston rod extending from the piston through the second chamber and outwardly beyond one end of the tilt cylinder, the piston rod is disposed at the swivel bracket or the clamping bracket, another end of the tilt cylinder is disposed at the other of the clamping bracket or the swivel bracket, and the relief valve relieves the pressure applied to the working fluid in the first chamber or the second chamber, wherein the adjustment mechanism is formed at a side surface of the tilt unit.

20. A hydraulic tilt system for a marine propulsion device comprising a tilt cylinder, a piston slidably disposed within the tilt cylinder, the tilt cylinder defining first and second chambers with the piston, a piston rod extending from the piston through the second chamber and outwardly beyond one end of the tilt cylinder, a fluid pump arranged to selectively pressurize working fluid within the first chamber or the second chamber, a relief valve arranged to relieve a pressure that is applied to the first chamber or the second chamber when the pressure exceeds a preset magnitude, an adjustment mechanism arranged to adjust the preset magnitude, a bracket assembly configured to be mounted to an associated watercraft, and a portion of the adjustment mechanism extends through a front surface of the hydraulic tilt system towards the bracket assembly.

21. The hydraulic tilt system for a marine propulsion of claim 20, wherein the portion of the adjustment mechanism is positioned between a mounting bracket of the bracket assembly that is disposed at a location in front of a drive unit.

22. A marine propulsion device comprising a drive unit adapted to be mounted on an associated watercraft for pivotal movement about a tilt axis that extends generally horizontally, a hydraulically operated tilt unit arranged to operate between the drive unit and the watercraft, a fluid pump pressurizing working fluid within the tilt unit, means for relieving the pressure of the working fluid within the tilt unit when the pressure exceeds a preset magnitude, and means for adjusting the preset magnitude, wherein the means for adjusting the preset magnitude is exposed and forms a forward portion of the tilt unit.

23. The marine propulsion device as set forth in claim 22, wherein said means for adjusting the preset magnitude is disposed at an inaccessible location on the marine propulsion device when the marine propulsion device is mounted on the associated watercraft.

24. A marine propulsion device comprising a drive unit adapted to be mounted on an associated watercraft for pivotal movement about a tilt axis that extends generally horizontally, a hydraulically operated tilt unit arranged to operate between the drive unit and the watercraft, a fluid pump pressurizing working fluid within the tilt unit, a relief valve communicating with the tilt unit so as to relieve the pressure of the working fluid within the tilt unit when the pressure exceeds a preset magnitude, and an adjustment mechanism arranged to adjust the preset magnitude, wherein the adjustment mechanism is positioned at a front portion of tilt unit.

25. The marine propulsion device of claim 24, wherein the adjustment mechanism comprises an exposed screw configured to operate the adjustment mechanism.

* * * * *

UNITED STATES PATENT AND TRADEMARK OFFICE

CERTIFICATE OF CORRECTION

PATENT NO. : 6,948,988 B2
APPLICATION NO. : 10/444143
DATED : September 27, 2005
INVENTOR(S) : Yoshihiko Okabe It is certified that error appears in the above-identified patent and that said Letters Patent is hereby corrected as shown below:

On Title Page; Item 56 Foreign Patent Documents; Line 2

Please delete "12/0000" and insert therefore, --12/1997--

Column 3; Line 27:

After "FIG. 1", please add --.--

Column 3; Line 50:

Before "end", please delete "an"

Column 15; Line 3:

Please delete "structure," and insert therefore, --structure--

Column 16; Line 13 (Claim 1):

Please delete "commmunicating" and insert therefore, --communicating--

Column 16; Line 33 (Claim 4):

Please delete "claim 3," and insert therefore, --claim 3--

Column 16; Line 43 (Claim 5):

After "the", please add --propulsion--

Column 16; Line 67 (Claim 9):

Please delete "horizonally" and insert therefore, --horizontally--

UNITED STATES PATENT AND TRADEMARK OFFICE

CERTIFICATE OF CORRECTION

PATENT NO. : 6,948,988 B2
APPLICATION NO. : 10/444143
DATED : September 27, 2005
INVENTOR(S) : Yoshihiko Okabe It is certified that error appears in the above-identified patent and that said Letters Patent is hereby corrected as shown below:

Column 17; Line 26 (Claim 11):

Please delete "horizonally" and insert therefore, --horizontally--

Column 18; Line 13 (Claim 15):

Please delete "pressurizied" and insert therefore, --pressurized--

Column 18; Line 48 (Claim 19):

After "with", please add --the--

Signed and Sealed this

First Day of May, 2007

JON W. DUDAS
*Director of the United States Patent and Trademark Office*